United States Patent [19]

Ringgenberg

[11] Patent Number: 4,650,001

[45] Date of Patent: Mar. 17, 1987

[54] ASSEMBLY FOR REDUCING THE FORCE APPLIED TO A SLOT AND LUG GUIDE

[75] Inventor: Paul D. Ringgenberg, Duncan, Okla.

[73] Assignee: Halliburton Company, Duncan, Okla.

[21] Appl. No.: 797,727

[22] Filed: Nov. 12, 1985

[51] Int. Cl.[4] ..... E21B 34/10

[52] U.S. Cl. ..... 166/373; 166/240; 166/321

[58] Field of Search ..... 166/240, 336, 373, 374, 166/386, 250, 264, 162, 169, 320, 321, 331

[56] References Cited

U.S. PATENT DOCUMENTS

| | | | |
|---|---|---|---|
| 3,082,831 | 3/1963 | Le Bus, Sr. | 166/240 X |
| 3,823,773 | 7/1974 | Nutter . | |
| 3,986,554 | 10/1976 | Nutter . | |
| 4,105,075 | 8/1978 | Helmus . | |
| 4,295,361 | 10/1981 | McMahan . | |
| 4,355,685 | 10/1982 | Beck . | |
| 4,403,654 | 9/1983 | Haynes | 166/240 X |
| 4,403,659 | 9/1983 | Upchurch . | |
| 4,545,431 | 10/1985 | Fore | 166/240 X |

*Primary Examiner*—Stephen J. Novosad
*Assistant Examiner*—William P. Neuder
*Attorney, Agent, or Firm*—Joseph A. Walkowski

[57] ABSTRACT

Assembly for reducing the force applied to a guide lug received in a slot. An outer telescoping member includes a guide lug extending from the radially inner surface thereof which is received in a groove formed on the radially outer surface of an inner tubular member with the lug and groove controlling relative axial movement between the inner and outer tubular members. The inner tubular member includes a load lug on the radially outer surface thereof for abutting against an annular shoulder disposed about the radially inner circumference of the outer tubular member to prevent the guide lug from exerting significant axial forces on the groove.

16 Claims, 22 Drawing Figures

ASSEMBLY FOR REDUCING THE FORCE APPLIED TO A SLOT AND LUG GUIDE

BACKGROUND OF THE INVENTION

The present invention relates generally to apparatus for guiding relative movement between first and second members, and more particularly, but not by way of limitation, to downhole tools including telescoping inner and outer tubular members, relative movement between which is defined by a slot and lug means.

In many downhole tools for use in performing various testing and treating operations and the like on oil wells, it is desirable to interconnect telescoping inner and outer tubular members by a slot and lug means so that upon exertion of external forces upon one of the inner and outer tubular members, the motion of the one member relative to the other is defined by the permissible movement of the lug within the slot. Such slot configurations are generally referred to as J-slots because they very often have the shape of the letter "J", even though many of the slots are very complex in their configurations.

One example of a prior art slot and lug mechanism is shown in U.S. Pat. No. 4,355,685 to Beck, and assigned to the assignee of the present invention. The slot or groove of Beck is shown in detail in FIGS. 2-4. Instead of the usual machined lug, a ball 124 in FIG. 1C is biased into the groove and thereby causes relative movement of the tubular members in accordance with the groove pattern.

Ball operated J-slots such as those disclosed in Beck transmit large forces through the ball between the inner and outer tubular members when the ball abuts against an axial end of the slot. Such forces may be generated through axial movement of a drill string from which a tool having the Beck J-slot is suspended or may be generated by application of several thousand pounds per square inch of pressure to the drill string or to the annulus between the drill string and the well bore. Such large forces can deform or destroy the ball and its associated structure.

U.S. Pat. No. 3,823,773 to Nutter discloses a slot, shown in FIG. 3, having a lug 104, also shown in FIG. 3 and in FIG. 2B, received therein. In a similar fashion to the ball operated J-slot of Beck, the lug and its associated structure are subject to large forces which may be transmitted between the tubular members that are positioned by the lug and slot device of Nutter. As in Beck, such large forces adversely affect the lug and its associated structure.

SUMMARY OF THE INVENTION

The downhole tool of the present invention includes first and second telescoping tubular members. Motion control means are operatively associated with the first and second telescoping members for controlling relative axial movement therebetween. Included in the motion control means is a groove disposed in one of the members having a guide lug which is associated with the other of the members received therein. First and second abutment surfaces are associated with the first and second telescoping tubular members, respectively. The tubular members, motion control means, and abutment surfaces are so arranged and constructed that when the guide lug is in an axially extreme position within a leg of the groove, the first abutment surface supportingly engages the second abutment surface to prevent the guide lug from exerting significant axial force on the groove.

Numerous objects, features, and advantages of the present invention will be readily apparent to those skilled in the art upon the reading of the following disclosure when taken in conjunction with the accompanying drawings, wherein:

FIGS. 1A-1F comprise a quarter section elevational view of a downhole tool incorporating the assembly of the present invention.

FIGS. 9A-F comprise an elevational quarter section view showing a downhole tool incorporating a second embodiment of the assembly of the present invention.

Figure 9A:
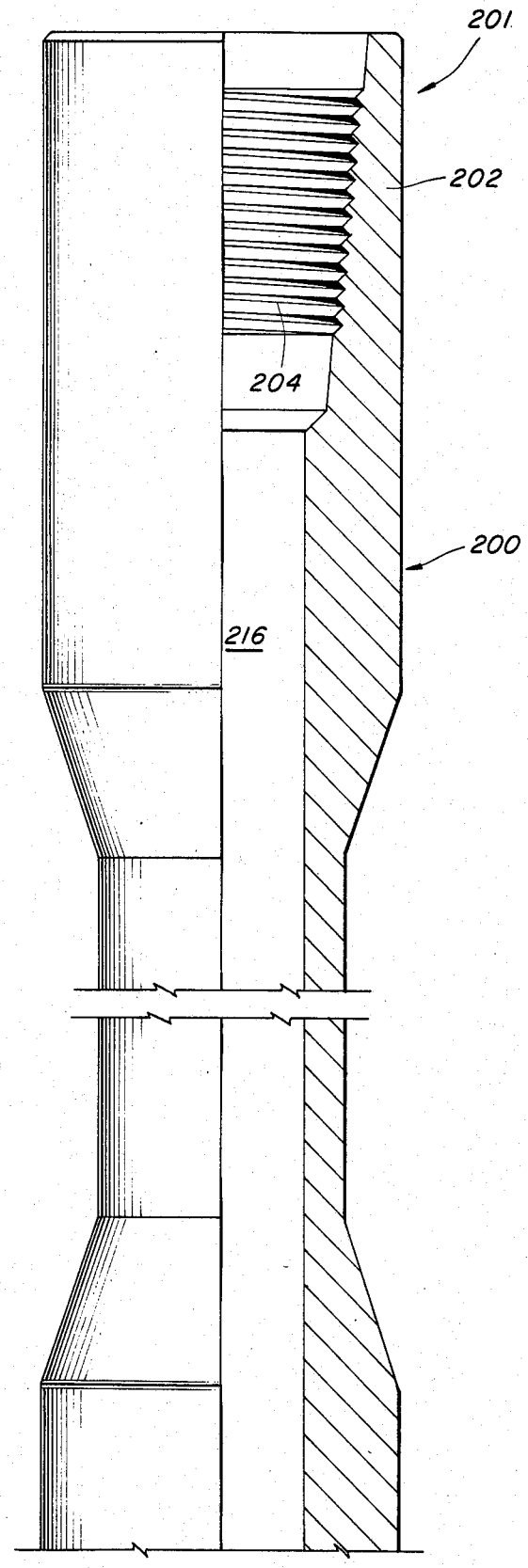
Figure 9B:
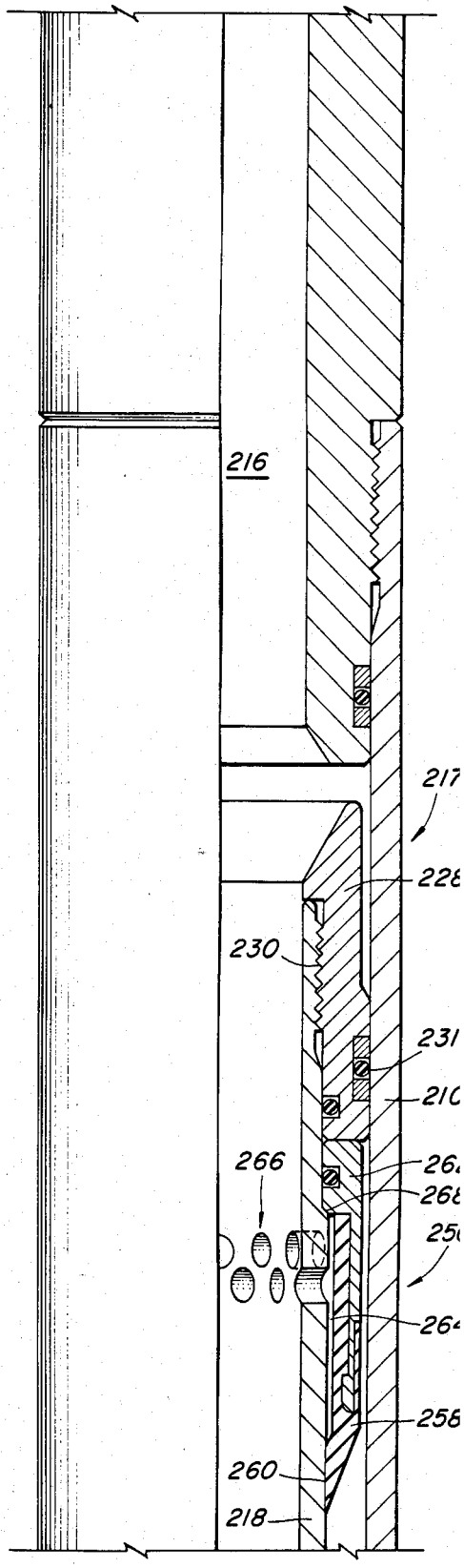
Figure 9C:
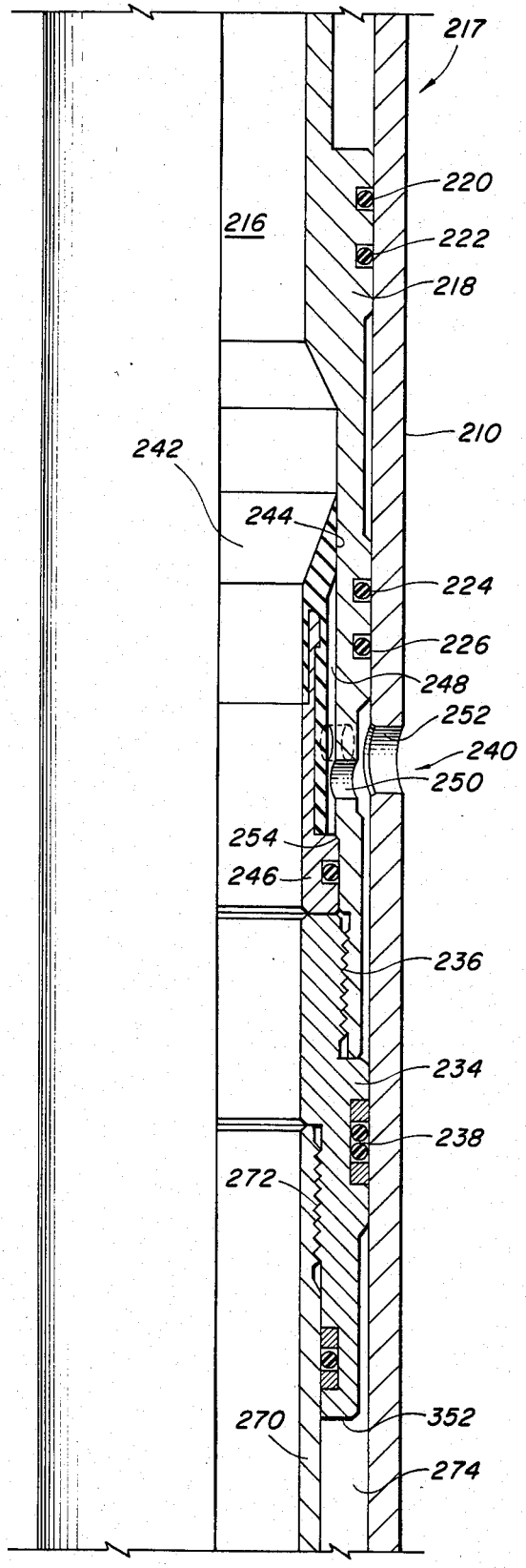
Figure 9D:
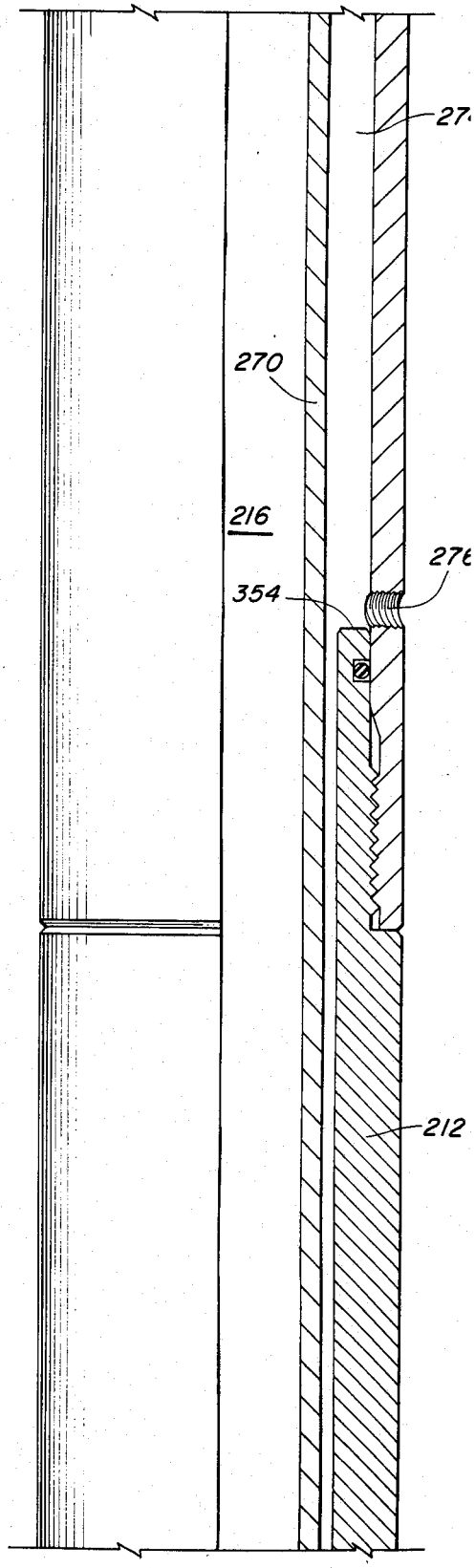
Figure 9E:
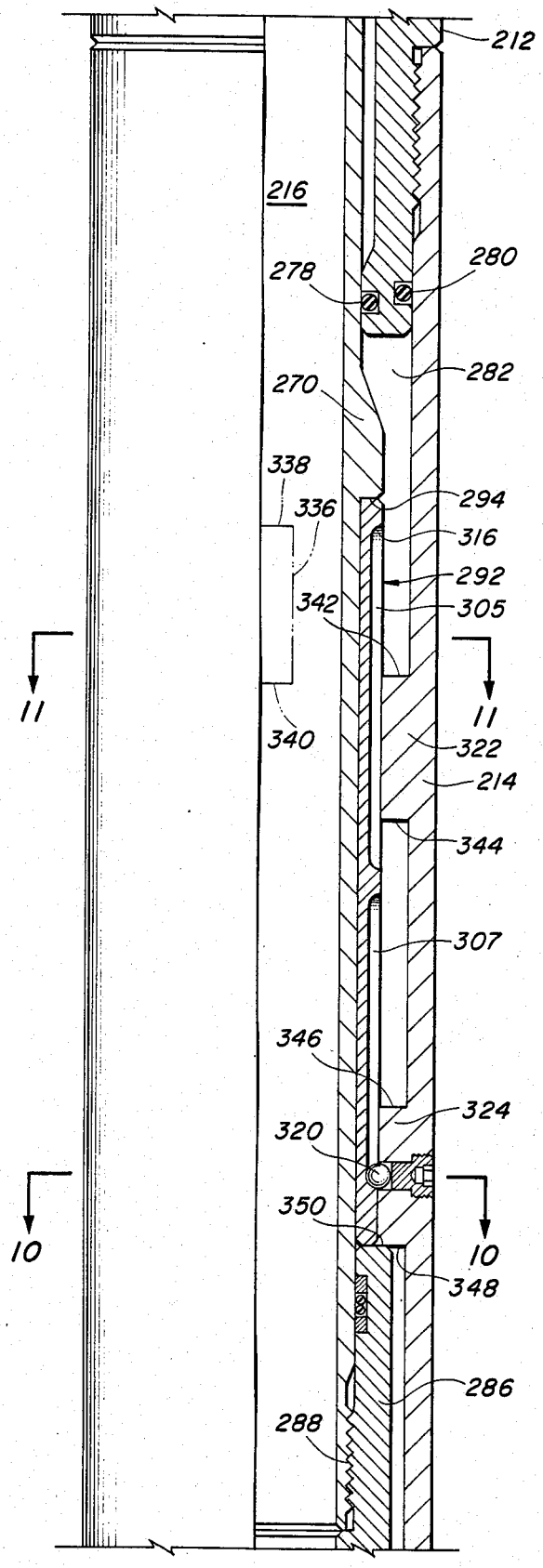
Figure 9F:
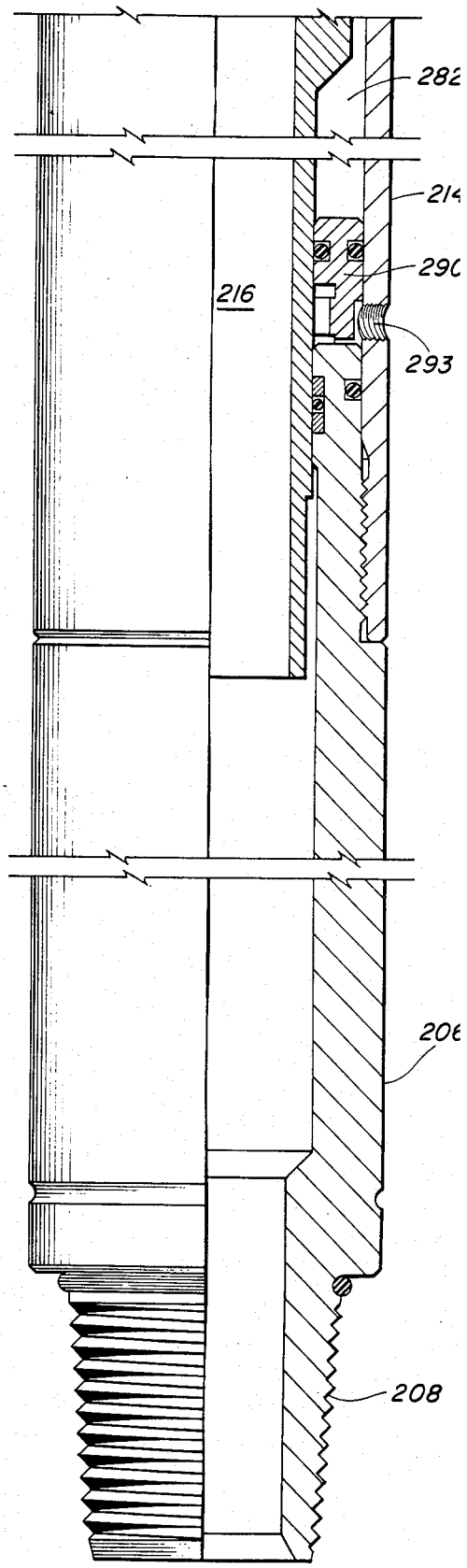
Figure 10:
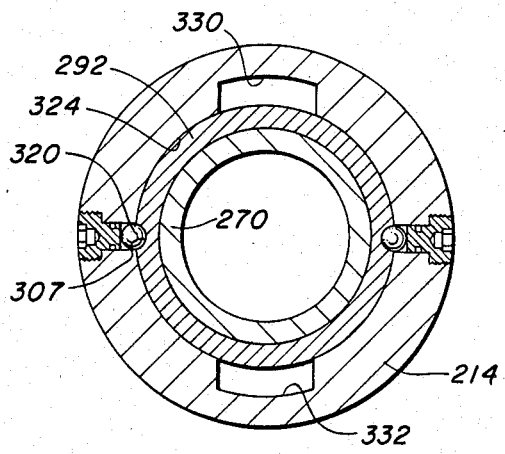

FIG. 10 is a cross-sectional view taken along lines 10—10 in FIG. 9E.

Figure 11:
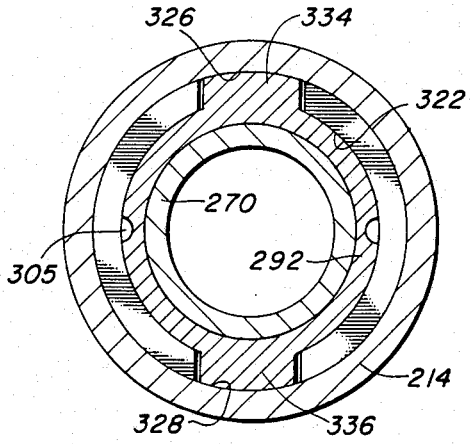

FIG. 11 is a cross-sectional view taken along 11—11 in FIG. 9E.

Figure 12:
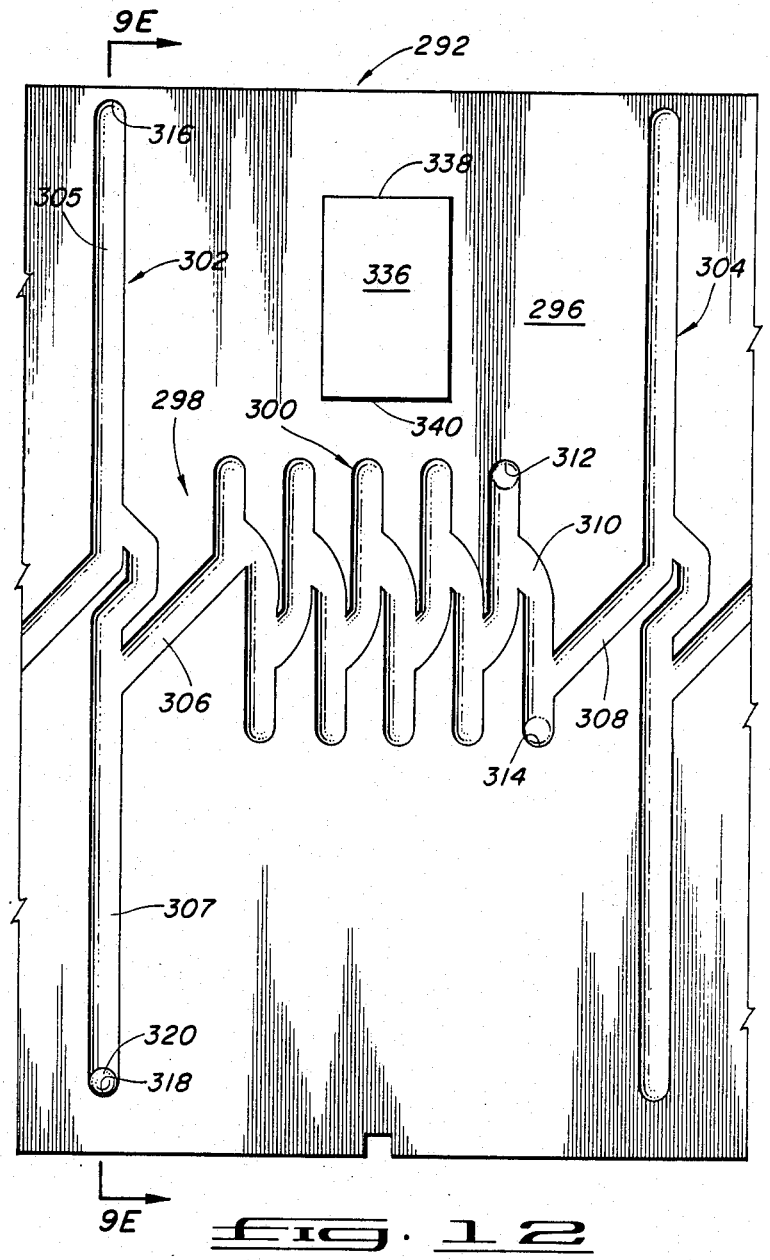

FIG. 12 is a laid-out view of a portion of the indexing sleeve of FIG. 9E showing the appearance of the sleeve as if it had been cut along its length at one side and then rolled out flat into a rectangular shape. The line 9E—9E indicates the location of the section through the sleeve which is seen in FIG. 9E.

Referring now to the drawings and particularly FIGS. 1A-1F, a downhole tool constructed in accordance with the instant invention is indicated generally at 10.

Downhole tool 10 is a recloseable circulation valve for use in oil well testing, which is a slightly modified version of the circulation valve disclosed and claimed in U.S. Pat. No. 4,355,685 to Beck and assigned to the assignee of the present invention. The particular manner of operation of downhole tool 10 of the present invention is substantially the same as that described in the Beck patent, which description is incorporated herein by reference. Those portions of downhole tool 10 of the present invention, other than the components specifically related to the force reducing assembly, will be described herein only in a brief fashion sufficient that the improvement provided by the force reducing assembly may be appreciated.

Downhole tool 10 includes a cylindrical housing 12 which is made up of an upper housing adapter 14, an upper intermediate housing section 16 (such including an abutment surface 17 on the lower end thereof), an indexing housing section 18, a passageway housing section 20, a nitrogen chamber housing 22, a lower intermediate housing section 24, an oil chamber housing 26 and a lower housing adapter 28.

Cylindrical housing 12 includes a longitudinal passageway 29 disposed therethrough, said passageway 29 being comprised of the various internal surfaces of the components of cylindrical housing 12 just described.

Figure 1A:
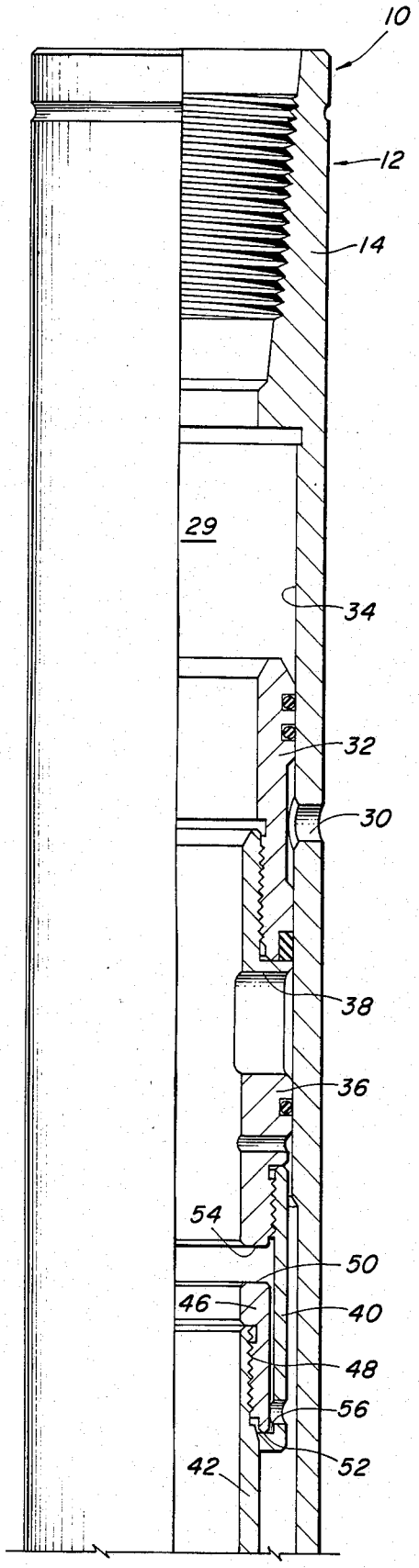

Upper housing adapter 14 includes a circulation port 30 disposed through a side wall thereof. A circulation valve cover sleeve 32 is closely received within an inner bore 34 of upper housing adapter 14 and is movable between a first closed position, as shown in FIG. 1A closing circulation port 30. When circulation valve cover sleeve 32 is in its open position it is displaced upwardly relative to upper adapter 14 from the position shown in FIG. 1A.

Circulation valve cover sleeve 32 is connected to a circulation valve opening mandrel 36 which has a port 38 disposed therein for communication with the circulation port 30 when the circulation valve cover sleeve 32 is moved upwardly to its open position. Connected to the lower end of circulation valve opening mandrel 36 is a lower circulation valve sleeve 40.

A circulation valve operating mandrel 42 is closely received within an inner cylindrical surface 44 of upper immediate housing section 16. An operating collar 46 is threadedly attached to the upper end of circulation valve operating mandrel 42 at threaded connection 48. Operating collar 46 has a greater outer diameter than does operating mandrel 42 and includes upward and downward facing surfaces 50, 52, respectively.

Longitudinal movement of operating mandrel 42 and operating collar 46 relative to circulation valve opening mandrel 36 and lower circulation valve sleeve 40 is limited by engagement of surface 50 with a downward facing surface 54 of circulation valve opening mandrel 36 and by engagement of surface 52 with an upward facing surface 56 of lower circulation valve sleeve 40.

It can be seen that a certain amount of longitudinal movement of operating mandrel 42 may occur prior to engagement of either of the surfaces 50 or 52 with respective surfaces 54 and 56. Upon engagement of surface 50 with surface 54 when operating mandrel 42 is moving upward relative to cylindrical housing 12, the circulation valve opening mandrel 36 is then moved upward with operating mandrel 42 to move circulation valve cover sleeve 32 to its open position.

Upon downward movement of operating mandrel 42, when surface 52 engages surface 56, further downward movement of operating mandrel 42 moves circulation valve opening mandrel 36 downward so that circulation valve cover sleeve 32 is moved to its closed position.

Figure 1B:
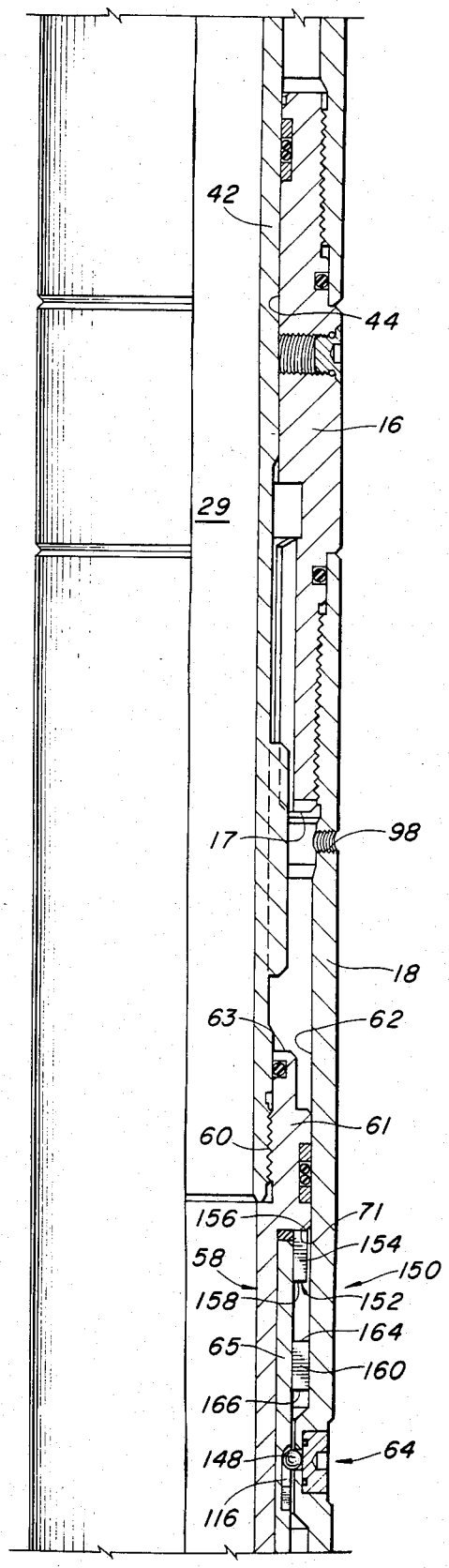

Referring now to FIG. 1B, the lower end of circulation valve operating mandrel 42 is threadably connected to a piston mandrel 58 at threaded connection 60. Piston mandrel 58 includes an annular power piston 61 formed on the upper end thereof which is closely received within an inner cylindrical surface 62 of indexing section housing 18. Power piston 61 includes an upward-facing or abutment surface 63. A lug and slot type indexing section or guide means generally designed by the numeral 64 is connected between piston mandrel 58 and indexing housing section 18 of housing 12 to define the permissible relative movement between piston mandrel 58 and the components attached thereto relative to the cylindrical housing 12. The indexing section includes an indexing sleeve 65 which is closely received over mandrel 58. Indexing section 64 is described in more detail below after completion of the general description of downhole tool 10.

A lower end 66 of piston mandrel 58 is closely received within an inner cylindrical surface 68 of passageway housing section 20.

An annular space 70 is defined between sleeve 65 and cylindrical housing 12 and is communicated with a lower end or abutment surface 71 of power piston 61.

Connected to an internally threaded lower end of passageway housing section 20 is an upper inner tubular sleeve 72. Attached to the lower end of sleeve 72, as seen in FIG. 1D is a lower inner tubular sleeve 74. A lower end of lower inner tubular sleeve 74 is received within intermediate housing section 24 as shown in FIG. 1E. A flow restriction apparatus or metering cartridge 76, to be described more fully hereinafter, is received beneath the lower end of housing 24 and is connected via threads 77 to the upper end of a tubular member 79.

Defined between upper inner tubular sleeve 72 and nitrogen chamber housing 22 of housing 12 is an annular nitrogen chamber 78.

Defined between lower tubular sleeve 79 and oil chamber housing 26 of housing 12 is an annular oil chamber 80.

Disposed in nitrogen chamber 78 is a first floating piston 82 which separates nitrogen in nitrogen chamber 78 from oil in oil chamber 80, and which transfers pressure therebetween.

Located in nitrogen chamber 80 is a second floating piston 84 which separates oil in oil chamber 80 from annulus fluid communicated with the lower side of second floating piston 84 through a port 86 through the side of oil chamber housing 26.

Nitrogen chamber 78 is communicated with annular space 70 through a passageway 88 disposed longitudinally through the wall of passageway housing section 20.

The lower end of first floating piston 82 is communicated with oil chamber 80 through an annular space 90 defined between lower inner tubular sleeve 74 and nitrogen chamber housing 22, and an annular clearance 94 between housing section 24 and lower inner tubular sleeve 74, and through metering cartridge 76.

Annulus fluid is communicated with the upper end of power piston 61 through a power port 98 through the side wall of indexing housing section 18.

Metering cartridge 76 permits flow of oil between chamber 80 and annular clearance 94, but only at a relatively slow rate, even in response to a large increase or decrease in pressure chamber 80. Thus, the metering cartridge serves as a time delay in communicating pressure increases and decreases from oil chamber 80 to nitrogen chamber 78.

Figure 1C:
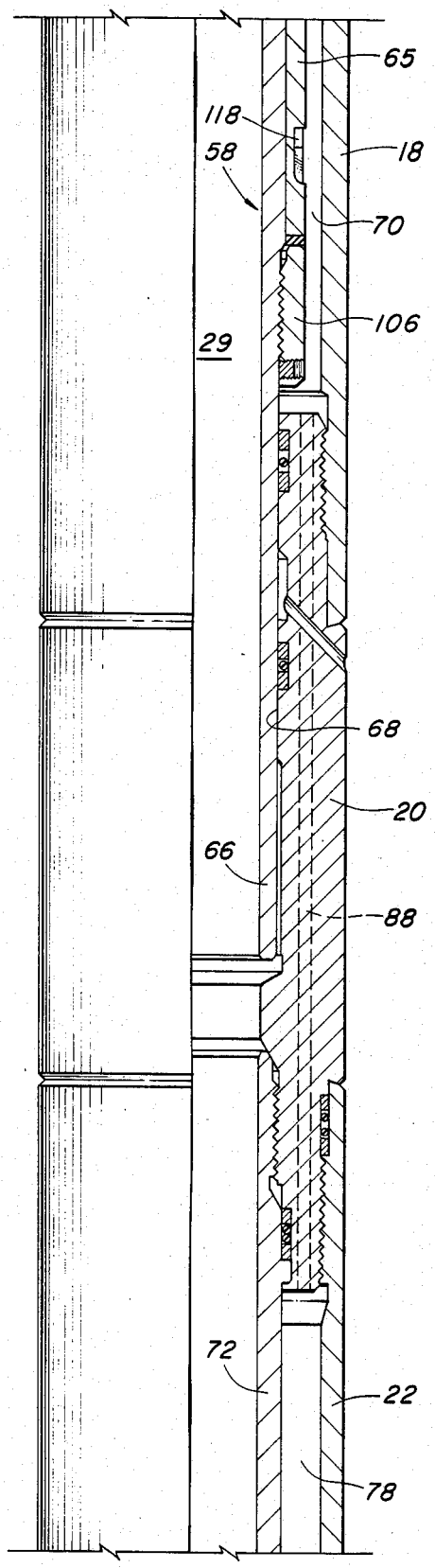
Figure 1D:
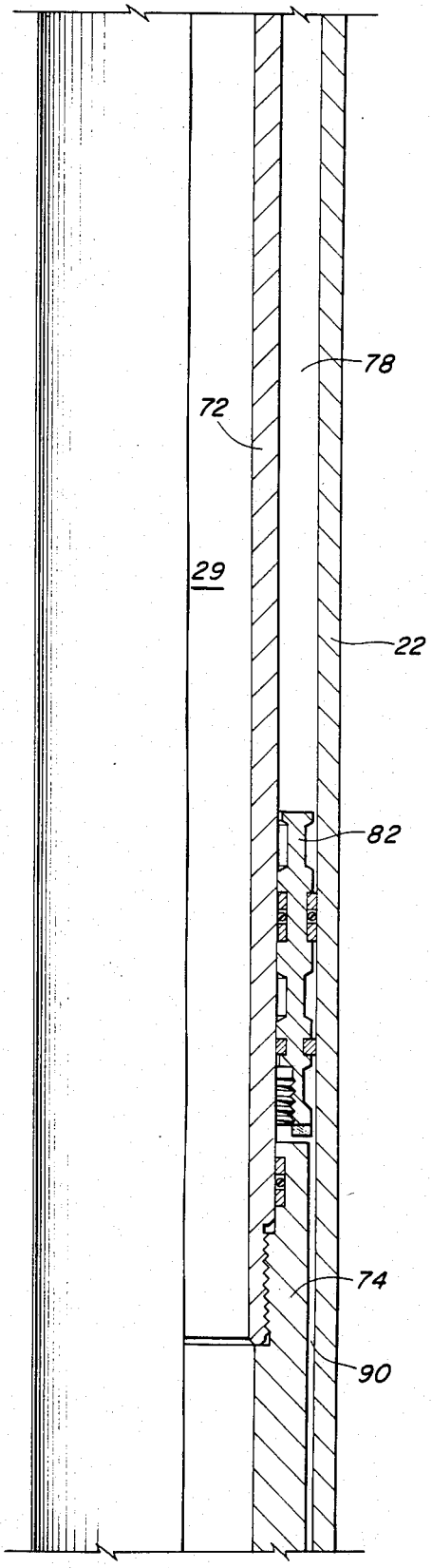
Figure 1E:
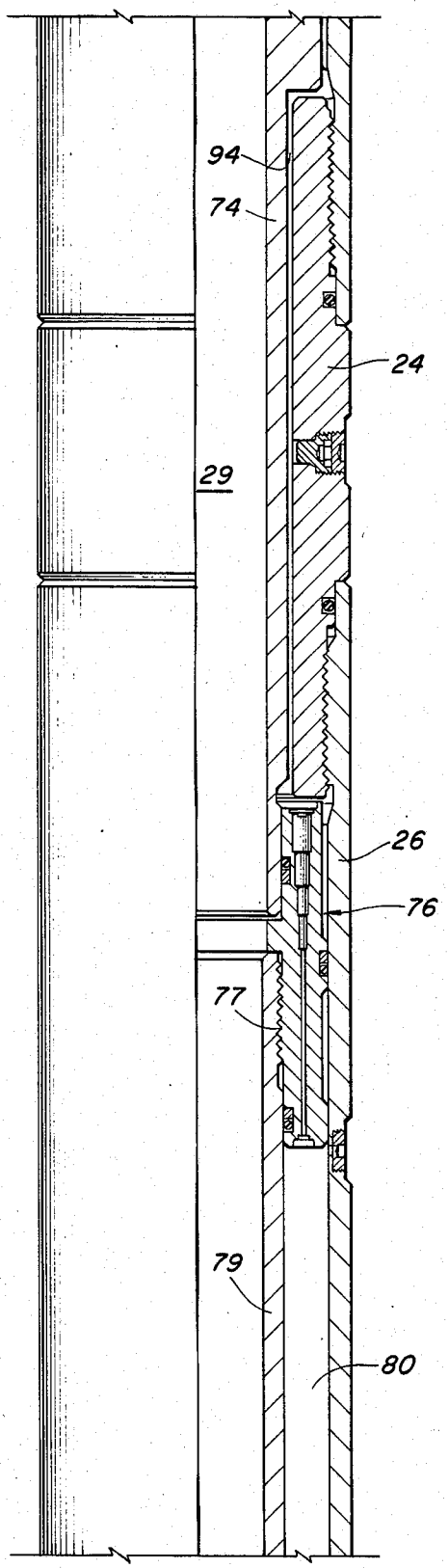
Figure 1F:
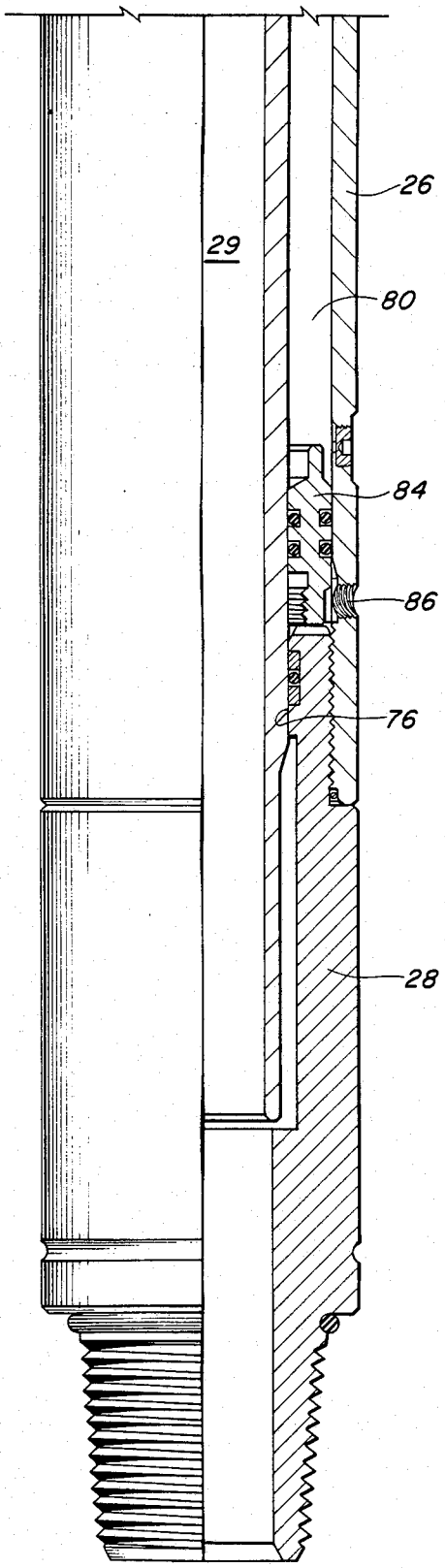

Referring once again to the indexing section generally designated by the numeral 64 in FIGS. 1B and 1C, indexing sleeve 65 is disposed about piston mandrel 58 and retained in place thereon by means of a retaining collar 106 and thrust washers as shown which permit sleeve 65 to rotate relative to piston mandrel 58.

Figure 6:
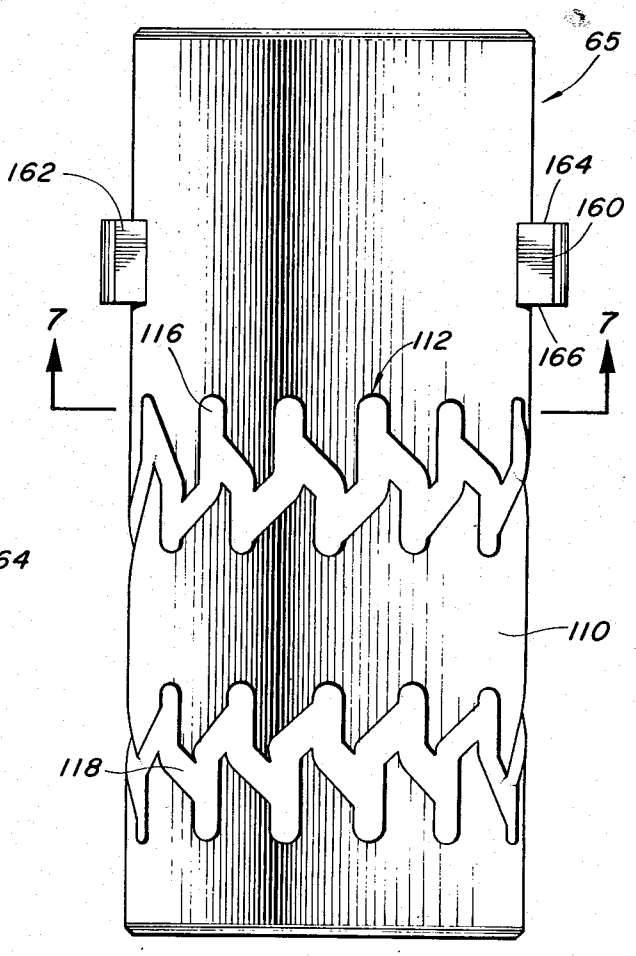
FIG. 6 is an elevation view of a cylindrical sleeve including a groove in the outer surface thereof.
Figure 7:
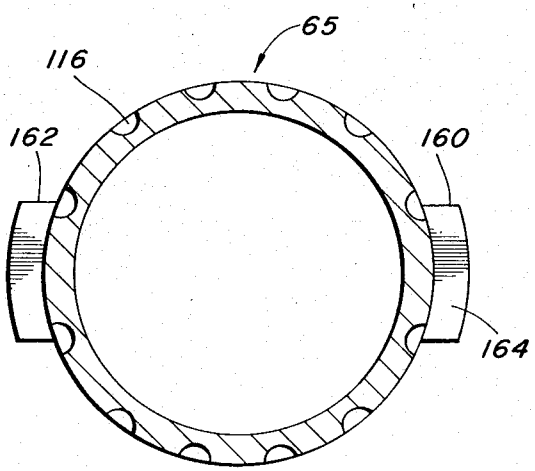
FIG. 7 is a cross-sectional view taken along lines 7—7 in FIG. 6.
Figure 8:
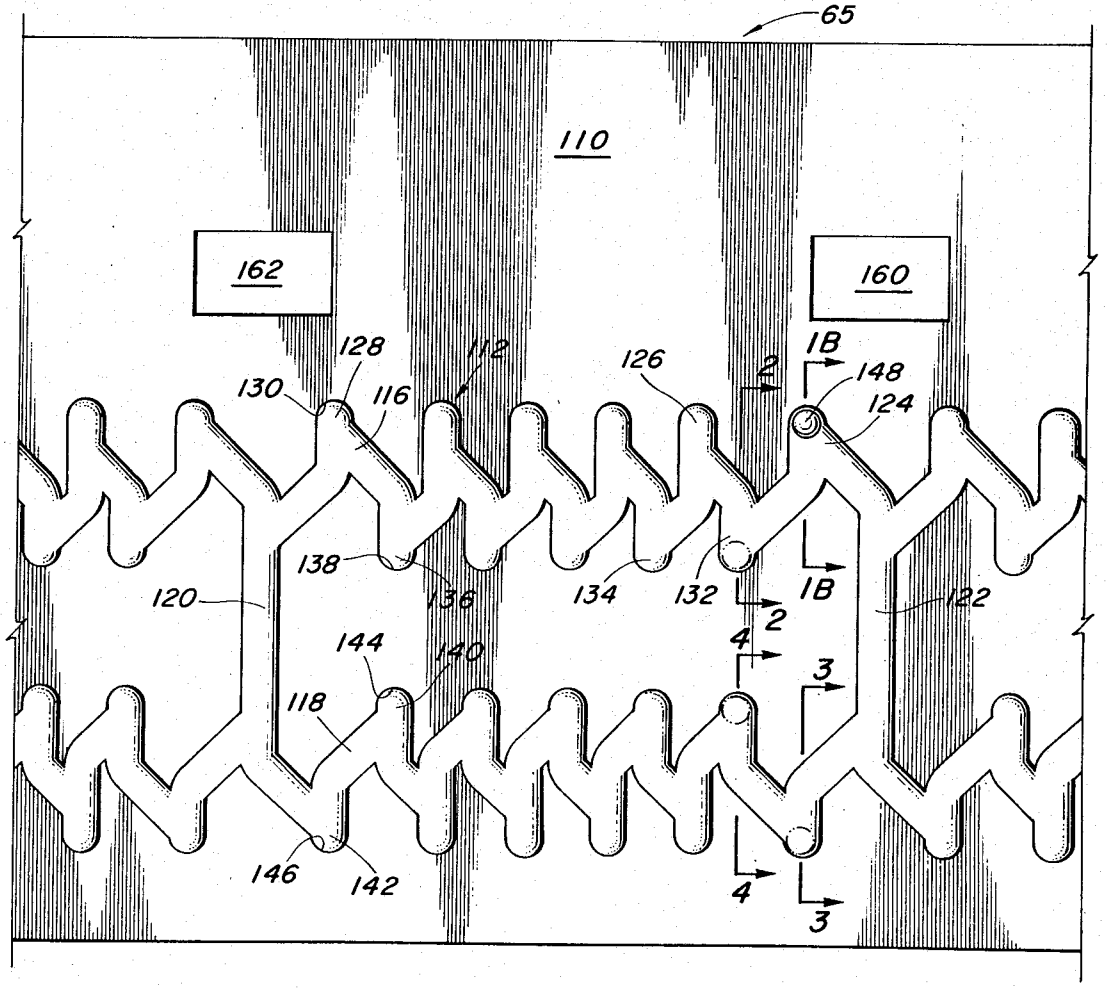
FIG. 8 is a laid-out view of the sleeve of FIG. 6 showing the appearance of the sleeve as if it had been cut along its length at one side and then rolled out flat into a rectangular shape. Lines 1B—1B, 2—2, 3—3, and 4—4 indicate the location of the section through which the sleeve is seen in FIGS. 1B, 2, 3, and 4, respectively.

Referring now to FIGS. 6, 7, and 8, indexing sleeve 65 has disposed in its outer cylindrical surface 110 a continuous groove or slot 112. Groove 112 includes an upper repeating zig-zag portion 116 for rotating sleeve 65 counter-clockwise as viewed from above upon reciprocation of piston mandrel 58 relative to housing 12.

Groove 112 includes a lower repeating zig-zag portion 118 for rotating sleeve 65 in a clockwise direction as viewed from above upon reciprocation of piston mandrel 58 relative to housing 12.

Slot 112 further includes first and second vertical groove portions 120, 122 for joining upper portion 116 to lower portion 118 as shown.

Groove 116 includes therein plurality of upper portions, like upper portions 124, 126, 128. As can best be seen in FIG. 7, groove 116 has a semi-circular cross section. Each of the upper portions includes an upper surface, like upper surface 130 in upper portion 128.

Groove 116 includes a plurality of lower portions, like lower portions 132, 134, 136, and each of the lower portions includes a lower surface, like lower surface 138 in lower portion 136. In a similar fashion, groove 118 includes plurality of upper portions, like portion 140 and a plurality of lower portions like portion 142, with upper portion 140 having an upper surface 144 and a lower portion 142 having a lower surface 146.

Turning back again to FIG. 1B, indexing section 64 includes therein a ball 148, such being held by indexing housing section 18 and being biased into groove 112. For a more detailed description of the structure of indexing section 64, attention is directed to the previously-mentioned Beck patent which description is incorporated herein by reference. Indicated generally at 150 is a force reducing assembly constructed in accordance with the instant invention. Included therein is an annular shoulder 152 formed on the radially inner surface of indexing housing section 18. The shoulder includes a slot 154, also viewable in FIG. 5, formed therein. Shoulder 152 includes an upper abutment surface 156 and a lower abutment surface 158. The shoulder is shown in cross section in FIG. 5. It will be noted that a slot, like slot 154 is located 180 degrees around indexing section 18 from slot 154 and it is to be appreciated that structure similar to that described in association with the portion of force reducing assembly 150 visible in FIG. 1B is repeated symetrically opposite thereto, although not shown herein. Indexing sleeve 65 includes mounted thereon load lugs 160, 162. Each of the load lugs includes an upper abutment surface like upper abutment surface 164 on load lug 160 and a lower abutment surface like abutment surface 166 on load lug 160.

The general manner of operation of downhole tool 10 is substantially the same as that of the Beck tool described in detail in U.S. Pat. No. 4,355,685. That operation may be generally summarized as follows. Downhole tool 10 provides a circulation valve which may be moved between its open and closed positions by repeatedly increasing and decreasing the pressure in the annulus between the drill string and the well bore hole. Annulus pressure is communicated with the upper end of power piston 61 through power port 98. Exerted on lower surface 71 of power piston 61 is the pressure of nitrogen gas contained in nitrogen chamber 78. When annulus pressure is applied, the pressure of nitrogen gas within nitrogen chamber 78 is initially at a lower pressure than that of the annulus due to the action of metering cartridge 76. The oil in oil chamber 80 is maintained at a pressure equal to the annulus pressure by means of second floating piston 84, the lower end of which is communicated with annulus fluid through port 86.

Upon repeated increasing and decreasing of the annulus pressure, power piston 61 is caused to reciprocate relative to housing 12 of downhole tool 10. This reciprocation causes ball 148 to move through groove 112.

At the surface of the bore, the tool is placed in the condition shown in FIGS. 1A–1D. That is, power mandrel 58 is supported by shoulder 154. More specifically, upper abutment surface 156 of the shoulder abuts against surface 71 on the lower side of annulur piston 61 of the power mandrel. After the tool is so positioned, chamber 78 is charged with nitrogen which as will be recalled communicates with the lower side of annulur piston 61 thereby urging the piston upwardly to the position shown in FIG. 2. Abutment surface 164 of lug 160 abuts against surface 158 of collar 154 thereby preventing further upward movement.

When the tool is in the position of FIG. 1B, ball 148 is received within portion 124 of groove 116 as shown in FIG. 8. It is to be appreciated that the power mandrel is supported by abutment surface 156 of shoulder 152 rather than by the action of ball 148 against the upper surface of groove portion 124.

When piston 61 and thus the mandrel and indexing sleeve 65 move upwardly in response to pressurization of the nitrogen chamber, indexing sleeve 65 moves until ball 148 is received within lower portion 132 of groove 116 as shown in dashed lines in FIG. 8. Again the ball does not serve as a stop to prevent further upward movement of sleeve 65 but rather surface 164 on lug 160 abuts against surface 158 of shoulder 152 thus halting further upward movement power mandrel 58 as seen in FIG. 1B. After the nitrogen chamber is fully charged, the tool is lowered into the well bore in the position shown in FIG. 2.

Figure 2:
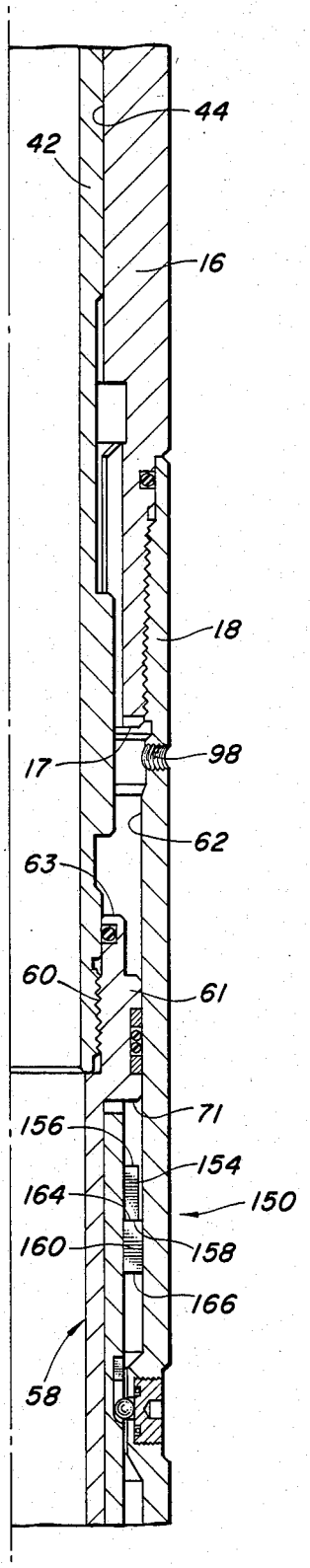
FIG. 2 is a section elevation right side only view similar to the view of FIG. 1B with the tool in a different configuration.

During the course of testing or treating the bore, it may be necessary or desirable to pressurize the annulus to operate various valves and testing apparatus. When the annulus is first so pressurized, pressure is communicated through port 98 to the upper surface of piston 61 thereby forcing mandrel 58 downward relative to housing 12. When such occurs, ball 148 is driven upwardly into upper portion 126 in FIG. 8 until surface 71 abuts against surface 156 as shown in FIG. 1B. Repeated pressurization and depressurization of the annulus rotates sleeve 65 relative to mandrel 58 as the ball is received in adjacent upper and lower portions of groove 116. Each time the ball is received in an upper portion of groove 116, further motion is halted, not by action of the ball against the upper groove surface but by action of surface 71 against surface 156 as shown in FIG. 1B. Each time the ball is received in a lower groove portion of groove 116, further motion is stopped by the action of surface 158 on surface 164 as shown in FIG. 2.

Figure 3:
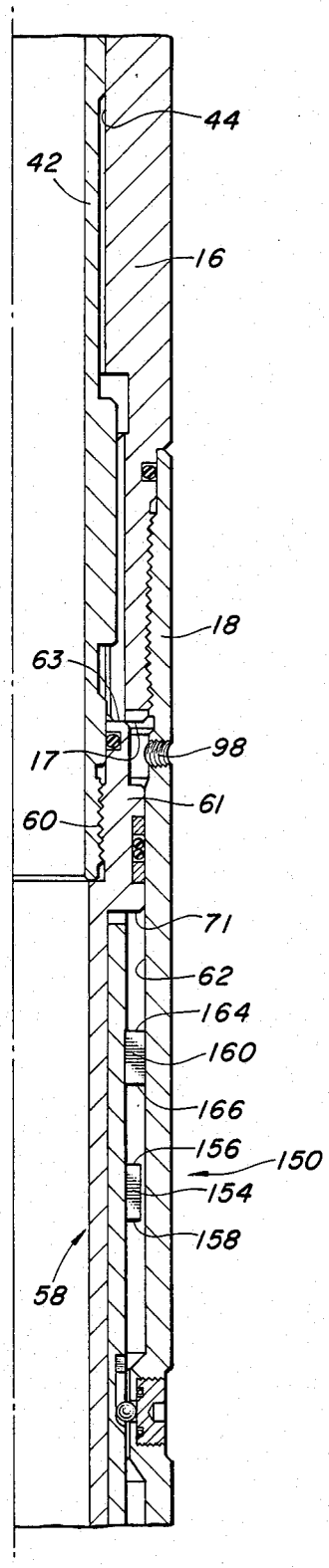
FIG. 3 is a section elevation right side only view similar to the view of 1B with the tool in another configuration.
Figure 5:
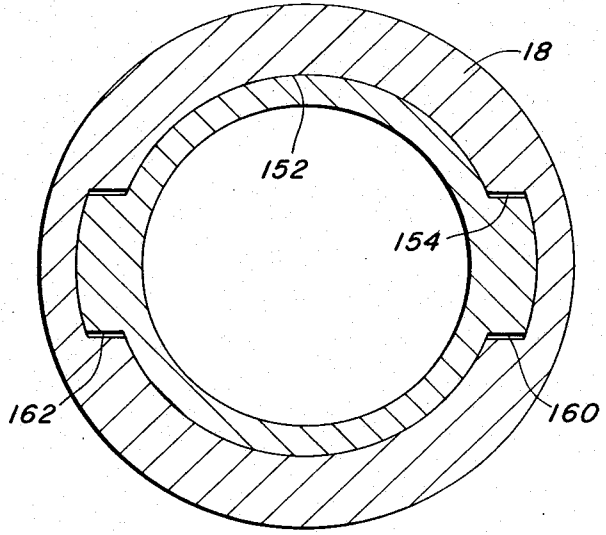
FIG. 5 is a cross-sectional view of the tool shown in FIGS. 1A-1F in still another configuration.

When the ball is received in lower portion 136 and the annulus is next pressurized, the ball is received in portion 128. When the annulus pressure is next released in response to the trapped pressure in nitrogen chamber 78, the ball moves into portion 120 and the indexing sleeve moves upwardly until the ball is received in lower portion 142 of groove 118. FIG. 5 is a cross-sectional view taken while ball 148 is received in portion 120 of groove 112. When the ball is in the groove portion 120, lug 160 is received within and passing through slot 154 of shoulder 152. As the ball moves into groove 118, lugs 160, 162 move above shoulder 152 as shown in FIG. 3. Just prior to engagement of the ball with lower surface 146 in the lower portion 142, surface 63 on the upper side of annular piston 61 engages surface 17 on the lower portion of housing 16 thus halting further movement of the mandrel in the housing. When the ball is received in either upper or lower portions, like portions 140, 142, of groove 118, the power mandrel is positioned so that port 30 communicates with port 38 thereby permitting circulation through these ports.

Figure 4:
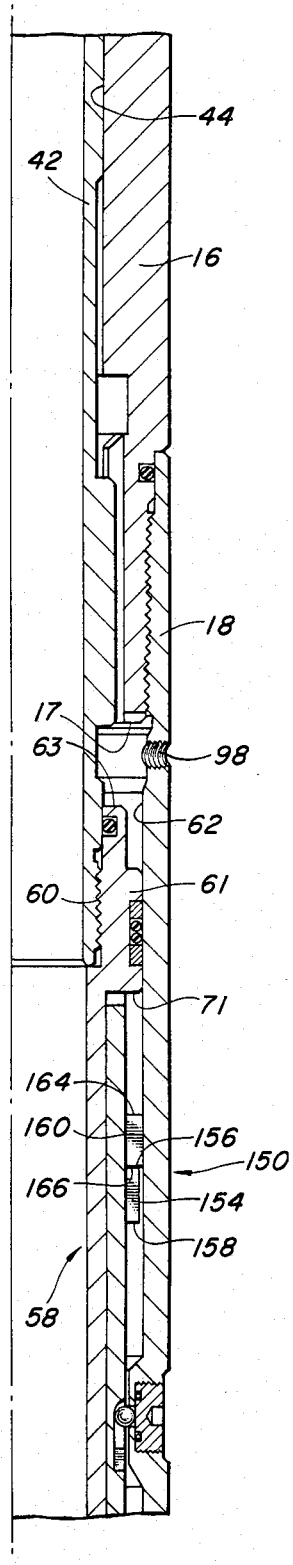
FIG. 4 is a section elevation right side only view similar to FIG. 1B with the tool in yet another configuration.

When ball 148 moves from portion 142 to portion 140 in response to an increase in annulus pressure, further downward movement of sleeve 65 is halted by abutment of surface 166 on the lower side of lug 160 against surface 156 on the upper side of shoulder 152 as shown in FIG. 4. Thereafter when annulus pressure is released and ball 148 moves to the adjacent lower portion to the right in slot 118 in response to the nitrogen pressure, further upward movement of the sleeve is halted by abutment of surfaces 63, 17 as in FIG. 3. Continued applications and releases of annulus pressure rotate the sleeve in a clockwise direction as viewed from above until ball 148 is received in portion 124 of groove 112 and is thus returned to the solid-line configuration in FIG. 8. Thereafter continued applications and releases of annulus pressure may be used to selectively open and shut the circulation valve as needed.

The use of abutment surfaces as described to prevent further motion of power mandrel 58 relative to housing 12 relieves ball 148 and its associated components from absorbing the force necessary to stop such motion.

Referring now to FIGS. 9A–9F, a second embodiment of the instant invention is incorporated in a tool indicated generally at 201.

Tool 201 includes a cylindrical outer housing, generally designated by the numeral 200, having an upper housing adapter 202 which includes threads 204 for attaching tool 201 to the portion of a testing drill string located above tool 201.

At the lower end of housing 200 is a lower housing adapter 206 which includes an externally threaded portion 208 for connection of tool 201 to a portion of the test string located below the tool.

Housing 200 further includes an upper housing section 210, an intermediate housing section 212 and a lower housing section 214. The interior of the components making up housing 200 forms a fluid flow passageway 216 axially through tool 201. The various housing sections and the upper and lower adapter are threadably connected to one another via threaded connections as shown in the drawing with each such threaded connection being sealed with O-rings as shown.

Indicated generally at 217 in FIGS. 9B and 9C is a circulation valve. A generally tubular valve mandrel 218 is closely received within upper housing section 210 and is sealingly engaged therewith via O-rings 220, 222, 224, and 226. An upper valve sleeve 228 is closely received within upper housing section 210 and is threadably engaged via threads 230 to the upper end of valve mandrel 218. An O-ring 231 sealingly engages the radially outer surface of upper valve sleeve 228 to the radially inner surface of upper housing section 210. A lower valve sleeve 234, in FIG. 9C, is threadably engaged via threads 236 to the lower end of valve mandrel 218 and is sealingly engaged thereto via O-ring seal 238.

Valve mandrel 218 includes a lower check valve indicated generally at 240. Included therein is a resiliant valve portion 242, such comprising an annular lip having a radially outer surface 244 which bears against the radially inner surface of valve mandrel 218. Valve portion 242 is inserted over and carried by a valve portion carrier 246. Carrier 246 supports valve portion 242 to create an annular space 248 between the radially outer surface of the valve portion and the radially inner surface of valve mandrel 218. A plurality of bores, one of which is bore 250, are formed through mandrel 210 about the circumference thereof and permit fluid communication between the exterior of the mandrel and space 248. Upper housing section 210 includes a circulating port 252 to permit fluid communication between the interior and exterior of upper housing section 210.

Valve carrier 246 is received between the upper end of lower valve sleeve 234 and a bevel 254 formed on the radially inner surface of valve mandrel 218 and is thus restrained from axial movement relative to the valve mandrel.

In FIG. 9B, an upper check valve is indicated generally at 256. Included therein is a resiliant valve portion 258 having an annular lip which has a radially inner surface 260 that is sealingly engaged against the radially outer surface of valve mandrel 218 about its circumference. Resiliant valve portion 258 is carried by a valve portion carrier 262. A space 264 is formed between the radially inner surface of resiliant valve portion 258 and the radially outer surface of the valve mandrel.

A plurality of bores indicated generally at 266 provide fluid communication between the interior of the valve mandrel 18 and space 264 about the circumference of the valve mandrel. Valve carrier 262 is received between the lower end of upper valve sleeve 228 and a bevel 268 formed on the radially outer surface of valve mandrel 218 about its circumference and is thus restrained from axial movement relative to the valve mandrel.

A piston mandrel 270 in FIG. 9C, 9D, and 9E has an upper end threadably secured via threads 272 to the lower end of lower valve sleeve 234. The radially outer surface of piston mandrel 270 and the radially inner surfaces of upper housing section 210 and intermediate housing section 212 define an upper annular space 274 which is in communication with the exterior of the tool via a power port 276. O-rings 278, 280 seal the radially inner and outer surfaces of intermediate housing section 212 and define the lower end of annular space 274. O-rings 278, 280 define the upper end of a lower annular space 282 which has as its outer boundry the radially inner surface of lower housing section 214. The radially inner boundry of space 282 is defined by the outer surface of piston mandrel 270 and the outer surface of a lower piston mandrel 286 which is threadably secured to the lower end of piston mandrel 270 via threads 288.

Disposed at the lower end of annular space 282 is an annular floating piston 290. Piston 290 is sealingly and slidingly received between the radially outer surface of the lower piston mandrel and the radially inner surface of lower housing section 214. Lower annular space 282 is filled with oil to provide lubrication to moving parts, to be hereinafter more fully described, contained within space 282. The lower side of floating piston 290 is in fluid communication with the exterior of tool 201 via a port 292 formed through the wall of lower housing section 214. The floating piston prevents drilling mud and other contaminates in the well bore from becomming mixed with the oil contained in annular space 282 above the floating piston.

In FIG. 9E, an indexing sleeve 292 is closely received over piston mandrel 270 and is restrained from axial movement therealong by a downward facing shoulder 294 formed on mandrel 270 and the upper surface of lower piston mandrel 286. For a better view of the structure associated with indexing sleeve 292, attention is directed to FIG. 12.

An outer cylindrical surface 296 on indexing sleeve 292 concludes a continuous slot or groove, such being indicated generally at 298. Groove 298 includes a repeating zig-zag portion 300 which rotates sleeve 292 counter-clockwise, as viewed from above, upon reciprocation of piston mandrel 270 relative to housing 200.

Groove 298 further includes first and second vertical groove portions 302, 304. Each of groove portions 302, 304 includes an upper and lower leg, like upper leg 305 and lower leg 307 in groove 302. Connecting groove portions 306, 308 connect repeating zig-zag portion 300 with vertical groove portions 302, 304. Zig-zag portion 300 includes a first leg 310 having an upper surface 312 and a lower surface 314. Each of the other legs in zig-zag portion 300 include similar upper and lower surfaces. Likewise, each of vertical grooves 302, 304 include upper and lower surfaces like upper surface 316 and lower surface 318 in groove 302.

A ball 320 is biased into groove portion 302 and more particularly into the lower portion of the groove as viewed in both FIGS. 12 and 9E.

In FIG. 9E, ball 320 is mounted on the radially inner surface of an annular shoulder 324 which is formed on the radially inner surface of lower housing section 214. For a more detailed description of ball 320, its associated structure, and the manner in which ball 320 interacts with indexing sleeve 292 see U.S. Pat. No. 4,355,685 to Beck which description is incorporated herein by reference.

An annular shoulder 322 is formed on the radially inner surface of lower housing section 214 about its circumference.

Annular shoulder 322 includes a pair of opposed slots 326, 328 which are viewable in FIG. 11.

Annular shoulder 324 includes a similar pair of opposed slots 330, 332 with slot 330 being axially aligned with slot 336 and slot 332 being axially aligned with slot 328.

Indexing sleeve 292 includes a pair of opposed load lugs 334, 336, such being viewable in FIG. 11. In the view of FIG. 11, opposing lugs 334, 336 are received within slots 326, 328, respectively. Load lug 336 is viewable in FIG. 12 and is shown in dot-dash lines in FIG. 9E, such indicating where load lug 336 is positioned on the rear side of index sleeve 292, with lug 334 being half cut away in the quarter section and half obscured by lower housing section 214.

Load lug 336 includes an upper abutment surface 338 and a lower abutment surface 340. Abutment surfaces 338, 340 comprise the upper and lower surfaces, respectively, of the load lug which extends outwardly from the radially outer surface of indexing sleeve 292.

In FIG. 9E, annular shoulder 322 includes upper and lower abutment surfaces 342, 344, respectively.

Also in FIG. 9E, shoulder 324 includes upper and lower abutment surfaces 346, 348, respectively. The upper surface of lower piston mandrel 286 comprise an abutment surface 350 with surface 348 being abutted against surface 350 in the view of FIG. 9E.

Additional abutment surfaces are seen in FIGS. 9C and 9D and include surface 352 on the lower end of lower valve sleeve 234 and surface 354 on the upper end of intermediate housing section 212. As will be explained hereinafter, the various abutment surfaces interact with one another to limit the axial movement of valve mandrel 218 and thereby place the valve in a closed condition, in a condition for circulation of fluids, or in a condition for reverse circulation of fluids.

In operation, prior to suspending tool 201 on a testing drill string in a well bore, mandrel 270 is axially reciprocated relative to housing 200 in order to place ball 320 in the lower end of leg 310 as shown in dashed lines in FIG. 12. In this position ball 320 is adjacent lower surface 314. When ball 320 is in the lower portion of leg 310 adjacent surface 314, abutment surface 338 of load lug 336 and the upper surface of the opposing load lug are abutted against abutment surface 344 on the underside of annular shoulder 322. When surfaces 338, 344 are so abutted, ball 320 is not abutted against surface 314 on the lower portion of leg 310 but rather is positioned just adjacent thereto.

When power piston 270 is positioned with ball 320 in leg 310 as described above, valve mandrel 218 is positioned over circulation port 252, in FIG. 9C, between O-rings 222, 224. Thus, fluid communication between passageway 216 and the exterior of tool 201 is prevented.

With the tool configured as described above, it is assembled into the drill string and lowered into the well bore. With this arrangement, fluids may be pumped into the drill string on which tool 201 is suspended for purposes of fracturing or injecting acid into the formation. Also, the annulus between tool 201 and the well bore may be pressurized in order to operate different tools in the drill string testing arrangement.

With ball 320 received in the lower portion of leg 310, when the drill string upon which the tool is suspended is pressurized, passageway 216 is pressurized thus forcing power mandrel 270 downwardly until ball 320 is received in the upper portion of leg 310, as shown in dashed lines in FIG. 12, adjacent surface 312. The power mandrel is urged downwardly under such pressurization due to the action of an annular piston which is defined by an outer diameter at seal 238 in FIG. 9C and by an inner diameter at O-ring 278 in FIG. 9E. Fluid pressure in passageway 216 acts across the difference in area between seal 238 and O-ring 278 to urge power mandrel 270 downwardly. As the mandrel moves downwardly ball 320 moves from the lower portion of leg 310 to the upper portion of leg 310 adjacent upper surface 312.

It is to be appreciated that downward movement of the power mandrel is stopped when lower abutment surface 340 on load lug 336 and the lower abutment surface on the opposing load lug strike upper abutment surface 346 on shoulder 324. Such occurs when ball 320 is in the position shown in dashed lines adjacent upper surface 312. Such abutment prevents ball 320 from abutting against surface 312 with a significant amount of force.

After ball 320 is positioned in the upper portion of leg 310, it may be necessary or desirable to operate a tool in the drill string testing arrangement by applying pressure to the annulus between the drill string and the well bore. Such pressure is communicated to upper annular space 274 via port 276 in FIG. 9D and serves to urge power piston mandrel 270 upwardly relative to housing 200. When such occurs, ball 320 moves downwardly into the lower portion of the leg adjacent leg 310. Further upward piston mandrel movement is stopped by the action of abutment surface 338 against abutment surface 344 on the lower surface of annular shoulder 322.

When ball 320 is received within zig-zag portion 300, although piston mandrel 270 and thus valve mandrel 218 are reciprocated between the upper and lower portions of groove 300, circulation port 252 is always between O-rings 222, 224, thus sealing the port from fluid communication between the interior and exterior of the tool.

It can be seen that by alternately pressurizing the drill string and the annulus, ball 320 will be successively moved along zig-zag portion 300 until it is received in the upper portion of the leg to the immediate right of connecting port 306.

When so positioned, annulus pressure may be applied to urge piston mandrel 370 upwardly thereby causing ball 320 to enter connecting portion 306 and thereafter lower leg 307 as the piston mandrel continues its upward movement. Abutment surface 338 does not strike abutment surface 344 on the lower surface of shoulder 233 as during piston mandrel reciprocation when ball 20 is received in zig-zag portion 300. This is because load lugs 334, 336 are received within slots 326, 328, in FIG. 11 and thus permit movement of ball 320 down lower leg 307.

Just prior to abutment of ball 320 against lower surface 318, abutment surface 348 on the lower side of shoulder 324 abuts against surface 350 on the upper side of lower piston mandrel 286 thus stopping further mandrel movement and preventing ball 320 from absorbing a significant axial load.

When ball 320 is in the lower end of leg 307 as shown in the solid-line view of FIG. 12 and FIG. 9E, valve mandrel 218 is positioned relative to port 252 as shown in FIG. 9C. When so positioned fluid may be reverse circulated through port 252, bore 250 (and the other bores about the perimeter of valve mandrel 218 adjacent bore 250), into annular space 248 on the radially inner surface of valve mandrel 218 and into passageway 216.

Thus, when valve mandrel 218 is in the configuration of 2C, the well may be reverse circulated but, because of the action of resiliant valve portion 242, the well may not be circulated from the drill string into the annulus. When pressure in passageway 216 is greater than the pressure in the annulus, surface 242 sealingly engages the radially inner surface of the valve mandrel thus preventing flow between passageway 216 and the annulus.

Since such flow may not occur, when it is desired to place the tool in condition for circulation, passageway 216 may be pressurized (by pressurizing the drill string) thus driving piston mandrel 270 downwardly and moving ball 320 upwardly in leg 307 and into leg 305 until the ball is adjacent surface 316. Just prior to impact of surface 316 with ball 320, surface 352 on the lower end of lower valve sleeve 234 abuts against surface 354 on the upper end of intermediate housing section 212 thus stopping further downward movement of piston mandrel and preventing ball 320 from bearing significant forces as a result of impact with surface 316.

When the piston mandrel is in its lowermost condition as just previously described, O-ring 220 on valve mandrel 218 is beneath circulating port 252 thus permitting circulation from passageway 216 into the well bore.

The use of abutment surfaces as described to prevent further motion of piston mandrel 270 relative to housing 200 relieves ball 320 and its associated components from absorbing the force necessary to stop such motion.

It is thus seen that the downhole tool of the present invention readily achieves the ends and advantages mentioned as well as those inherent therein. While presently preferred embodiments of the invention have been specifically described for the purposes of this disclosure, numerous changes in the arrangement and construction of parts can be made by those skilled in the art which changes are encompassed within the spirit and scope of this invention which is defined by the appended claims. For example, the invention is not limited to do a specific number of load lugs and slots; more lugs may be provided to further distribute forces and thus reduce those on an individual lug; the lugs may be incorporated into the tool housing and slotted annular shoulder provided on the indexing sleeve.

I claim:

1. A downhole tool comprising:

first and second telescoping tubular members;

motion control means operatively associated with said first and second telescoping members for controlling relative axial movement between said first and second telescoping tubular members, said motion control means including a groove disposed in one of said first and second tubular members and a guide lug associated with the other of said first and second telescoping tubular members, said guide lug being received in said groove; and first and second abutment surfaces associated with said first and second telescoping tubular members, respectfully, said first abutment surface including a slot formed therein through which said second abutment surface may pass when said second abutment surface is radially aligned therewith;

wherein said first and second tubular members, said motion control means, and said first and second abutment surfaces are so arranged and constructed that when said guide lug is at an axially extreme position within a leg of said groove, said first abutment surface supportingly engages said second abutment surface to prevent said guide lug from exerting significant axial forces on said groove.

2. The downhole tool of claim 1 wherein said groove includes upper and lower surfaces which said guide lug may approach and which thereby define preselected relative axial positions of said first and second telescoping tubular members and wherein said downhole tool further comprises additional abutment surfaces associated with said first and second telescoping tubular members, said additional abutment surfaces being arranged to engage one another when said first and second telescoping members approach such preselected relative axial positions to prevent said guide lug from exerting significant axial forces against said upper and lower groove surfaces.

3. The downhole tool of claim 1 wherein said first abutment surface comprises one side of an annular shoulder and wherein said guide lug is mounted on said shoulder.

4. The downhole tool of claim 3 wherein said second abutment surface comprises an edge of a load lug and wherein said annular ashoulder includes said slot through which said load lug may pass when said load lug is radially aligned therewith.

5. The downhole tool of claim 3 wherein said second telescoping member is slidingly received within said first telescoping member.

6. The downhole tool of claim 5 wherein said second abutment surface comprises an edge of a load lug extending outwardly from the radially outer surface of said second telescoping member.

7. The downhole tool of claim 6 wherein said annular shoulder includes said slot therein through which said load lug may pass when said load lug is radially aligned therewith.

8. In a guide lug and slot assembly for guiding inner and outer telescoping tubular members of a downhole tool into a preselected axial position relative to one another, the improvement comprising:

a first load lug comprising a substantially annular shoulder fixedly mounted on the radially inner surface of said outer tubular member; and a second load lug fixedly mounted on the radially outer surface of said inner tubular member, said load lugs abuttingly engaging one another when said inner and outer tubular members are guided by said lug and slot assembly to said preselected axial position, said annular shoulder including a slot therein of a size sufficient to permit passage of said second load lug therethrough when said slot and said second load lug are radially aligned with one another.

9. The assembly of claim 8 wherein said assembly further includes a third load lug mounted on one of the tubular members for abuttingly engaging one of the other load lugs when said inner and outer tubular members are guided by said lug and slot assembly to a second preselected axial position relative to one another.

10. The assembly of claim 8 wherein said inner and outer telescoping tubular members include additional load lugs fixedly mounted on said radially outer and inner surfaces, respectively, said additional load lugs abuttingly engaging one another when said inner and outer tubular members are guided by said lug and slot assembly to different preselected axial positions relative to one another.

11. The assembly of claim 8 wherein said second load lug includes a lower abutment surface for abutting against the upper side of said annular shoulder and an upper abutment surface for abutting against the lower side of said annular shoulder.

12. The assembly of claim 8 wherein said guide lug and slot assembly is of the type which generates relative rotational movement between said inner and outer telescoping tubular members during such guiding and wherein said second lug is alignable with said slot to enable said guide lug and slot assembly to guide said inner and outer telescoping tubular members to a relative axial position beyond said preselected axial position.

13. A downhole tool comprising:

first and second telescoping members;

a guide lug fixedly mounted on one of said first and second telescoping members;

a groove disposed in the other of said first and second telescoping members and having said guide lug received therein, said groove having a substantially axial leg which defines a preselected relative axial position of said first and second telescoping members when said guide lug approaches the end of said leg; and first and second load lugs fixedly mounted on said first and second telescoping members, respectively, said first and second load lugs being positioned relative to said guide lug and to said groove so as to abuttingly engage one another when said first and second telescoping members are in said preselected relative axial position, said first load lug comprising an annular shoulder having a slot formed therethrough, said slot being of a size sufficient for said second load lug to pass therethrough when said slot and said second load lug are radially aligned.

14. The downhole tool of claim 13 wherein said groove includes a second substantially axial leg which defines a second preselected relative axial position of said first and second telescoping members when said guide lug approaches an end of said second leg, and wherein said downhole tool further includes a third load lug fixedly mounted on one of said first and second telescoping members, said third load lug abuttingly engaging one of said other load lugs when said first and second members are in said second preselected relative axial position.

15. The downhole tool of claim 13 wherein said second telescoping member is received within said first telescoping member and wherein said downhole tool further includes a second annular shoulder spaced from said first annular shoulder, said second annular shoulder having a slot formed therethrough which is substantially aligned with the slot in said first annular shoulder.

16. The downhole tool of claim 15 wherein said tool further includes fourth and fifth load lugs mounted on said first and second telescoping members, respectively, said fourth and fifth load lugs defining another preselected relative axial position of said first and second telescoping members when said fourth and fifth load lugs abut against one another.

* * * * *